United States Patent [19]

Davis et al.

[11] 4,298,483

[45] Nov. 3, 1981

[54] METAL FORMING LUBRICANTS

[75] Inventors: Robert H. Davis, Pitman; Richard S. Herd, Woodbury, both of N.J.

[73] Assignee: Mobil Oil Corporation, New York, N.Y.

[21] Appl. No.: 104,494

[22] Filed: Dec. 17, 1979

[51] Int. Cl.[3] ..... C10M 1/48; C10M 3/42

[52] U.S. Cl. ..... 252/32.7 HC; 72/42; 252/32.7 R; 252/56 R; 252/49.5

[58] Field of Search ..... 252/32.7 R, 56 R, 32.7 HC, 252/49.5; 72/42

[56] References Cited

U.S. PATENT DOCUMENTS

| | | | |
|---|---|---|---|
| 2,419,325 | 4/1947 | Musselman | 252/32.7 R |
| 2,830,949 | 4/1958 | Berger et al. | 252/32.7 R |
| 2,864,846 | 12/1958 | Gragson | 252/32.7 R |
| 2,993,857 | 7/1961 | Sudholz | 252/32.7 R |
| 2,993,858 | 7/1961 | Sudholz | 252/32.7 R |
| 3,278,432 | 10/1966 | Davis | 252/40.7 |
| 3,496,106 | 2/1970 | Matson | 252/32.7 R |
| 4,028,259 | 6/1977 | Herd et al. | 252/32.7 R |

*Primary Examiner*—Delbert E. Gantz
*Assistant Examiner*—Irving Vaughn
*Attorney, Agent, or Firm*—Charles A. Huggett; Michael G. Gilman; James D. Tierney

[57] ABSTRACT

Organic acid esters and oils of lubricating viscosity which have been oxidized and phosphosulfurized in the presence of lime or zinc oxide provide excellent antiwear/EP characteristics to metal forming lubricants containing same.

15 Claims, No Drawings

METAL FORMING LUBRICANTS

BACKGROUND OF THE INVENTION

1. Field of the Invention

This invention is directed to antiwear/extreme pressure additives comprising a mixture of an organic acid ester and a phosphosulfurized oil.

2. Discussion of the Prior Art

Lubricants are subject to heavy stresses that can affect their antiwear and loading-carrying ability and lubricants used in metal working, heavy industrial machinery and the like are often subject to high temperatures and pressures which affect their extreme pressure properties. Prior art lubricant compositions have not always been adapted to withstand these extreme conditions. Thus there is a constant need and effort to discover classes of compounds that will aid in retaining or, preferably, in improving these important properties.

U.S. Pat. No. 3,278,432 discloses the use of alkaline earth metal salts of $C_1$–$C_4$ carboxylic acids and sulfur containing material such as sulfur, hydrocarbyl sulfides and sulfurized oils and fats as being useful in E.P. additive formulations and U.S. Pat. No. 4,028,259 discloses oil-soluble, phosphorus and sulfur containing oxidized oil reaction products as lube oil additives.

SUMMARY OF THE INVENTION

This invention is directed to metal working lubricants having improved antiwear/extreme pressure properties. The improved lubricant compositions contain organic acid esters and a hydrocarbon oil which has been oxidized and phosphosulfurized in the presence of a Group I or Group II metal oxide such as lime or zinc oxide. The improved lubricants of the present invention are useful, for example, in applications involving plastic deformation of metals. They are particularly useful in two-piece can forming where they are applied as a precoat lubricant prior to cupping and ironing operations thereby eliminating the need for further lubrication in the draw and iron operations.

DESCRIPTION OF SPECIFIC EMBODIMENTS

The lubricant additives embodied in the invention comprise a mixture of an organic acid ester and a phosphosulfurized oil. The organic acid esters are usually although not limited to esters of monocarboxylic acids having up to about 30 carbon atoms. Preferred are esters such as tall oil methyl ester and mixed $C_{10}$–$C_{18}$ methyl ester. The esters may be prepared from mono- and polyhydric alcohols having 1 to 6 carbon atoms reacted with organic acids having about 4 to 30 carbon atoms. The esters may also be obtained commercially.

The phosphosulfurized oil adduct may be prepared by reacting a mixture comprising a metal oxide and a suitable hydrocarbon in the presence of an oxidizing gas and then reacting the resulting product with a phosphorus sulfide. The hydrocarbons utilizable as starting materials in the process of the invention may comprise any hydrocarbon or mixture of hydrocarbons capable of providing a product which is soluble in lubricating oil. In general, this solubility requirement is satisfied by hydrocarbons having molecular weights of from about 200 to about 1,000, with those having molecular weights of from about 300 to about 600 being particularly suitable. The hydrocarbons may be saturated hydrocarbons and may be straight-chained, branch-chained or cyclic. Also, aromatic hydrocarbons which have substituent groups of sufficiently high molecular weight to provide an oil-solubilizing character to the final products can be used. Thus, alkaryl type hydrocarbons containing at least one aliphatic substituent of at least about 8 carbon atoms, or several such substituents totaling at least about 8 carbon atoms per molecule, are suitable. Examples of these would be octylbenzene, dodecylbenzene, waxbenzene and the like.

Petroleum oils and petroleum oil fractions, such as petrolatums, waxes, and the like, are a preferred class of hydrocarbon reactants, while refined oils, such as a solvent paraffinic neutral, are especially preferred. In terms of viscosity, oils having viscosities ranging from 2 to about 65 centistokes at 210° F. may be used, with those having viscosities of from about 6 to about 45 centistokes at 210° F. being preferred. The characteristics of several different types of suitable oil stocks are shown in Table 1.

TABLE 1

| Oil | Gravity, °API | Pour Point, °F. | K. V. at 210° F., cs | Avg. mol. wt. |
|---|---|---|---|---|
| Solvent-refined Mid-Continent distillate stock | 30.0 | 20 | 6.2 | 350 |
| Foots Oil | 36.3 | 90 | 3.6 | 360 |
| Slack wax | 29.8 | 85 | 25.8 | 700 |
| Solvent-refined Mid-Continent bright stock | 25.8 | — | 25.9 | 720 |
| Solvent-refined Mid-Continent bright stock | 26.3 | — | 32.9 | 840 |

The metal oxides utilizable as reagents in the invention are those of the metals of Groups I and II of the Periodic Table of the Elements. Specifically, the oxides of calcium, sodium, potassium, barium, strontium, zinc and magnesium are highly suitable, with calcium oxide being particularly preferred. Cobalt and molybdenum are also highly preferred.

The phosphorus sulfide reactant used in the process may be either $P_2S_5$, $P_4S_7$ or $P_4S_3$, with $P_2S_5$ being preferred. Mixtures of the sulfides can also be used. A detailed description of how the phosphosulfurized component may be prepared can be found in U.S. Pat. No. 4,028,259 which is incorporated herein in its entirety.

The antiwear/extreme pressure lubricant blends in accordance with the present invention contain from about 10 to 40 wt. % of the organic acid ester component and from about 60 to 90 wt. % of the phosphosulfurized oil.

Having discussed the invention in broad and general terms, the following is offered to illustrate it. It is to be understood that the Examples are merely illustrative and are not intended to limit the scope of the invention or the claims appended hereto.

EXAMPLE 1

A 200 SUS at 100° F. paraffinic oil.

EXAMPLE 2

Phosphosulfurized oil using lime was prepared in accordance with U.S. Pat. No. 4,028,259.

EXAMPLE 3

Phosphosulfurized oil using zinc was prepared in accordance with U.S. Pat. No. 4,028,259.

EXAMPLE 4

Tall oil methyl ester obtained commercially.

EXAMPLE 5

$C_{10}$–$C_{18}$ methyl ester obtained commercially.

Blends of the above exemplary materials were then evaluated for thread forming efficiency in accordance with Table 2.

THREAD FORMING TEST

The ability of the lubricant compositions to operate efficiently is measured by the thread forming test. In the test a series of holes is drilled and reamed to 0.2380 inches in SAE 10/8 steel. A thread rolling tap is used to form threads. The holes are threaded in a drill press equipped with a table which is free to rotate about the center on ball-bearings. A torque arm is attached to this "floating table" and the arm in turn activates a spring scale, so that the actual torque during the tapping, with the oil being evaluated, is measured directly. The same conditions used in evaluating the test oil are employed in threading with a strong oil which has arbitrarily been assigned an efficiency of 100%. The average torque in the test oil is compared to that of the standard and a relative efficiency is calculated on a percentage basis. For example, fifteen torque values are obtained with the test fluid and compared with fifteen reference fluid values to obtain percent thread forming efficiency; i.e.:

$$\% \text{ Forming Efficiency} = \frac{\text{Avg. 15 Reference Fluid Torque Values} \times 100}{\text{Avg. 15 Test Fluid Torque Values}}$$

Low test fluid torque values result in higher forming efficiency and improved performance in operation involving plastic deformation of metal.

TABLE 2

THREAD FORMING TEST RESULTS

| Blend | Example 1: 200 SUS @ 100° F. Paraffinic Oil % wt. | Example 2: Phospho-sulfurized Oil Using Lime % wt. | Exapmle 3: Phospho-sulfurized Oil Using Zinc wt. % | Example 4: Tall Oil Methyl Ester % wt. | Example 5: $C_{10}$—$C_{18}$ Methyl Ester % wt. | Thread Forming Efficiency % |
|---|---|---|---|---|---|---|
| A | 100 | — | — | — | — | 100 |
| B | — | 80 | — | 20 | — | 162.7 |
| C | — | 80 | — | — | 20 | 158.1 |
| D | 20 | 80 | — | — | — | 121.4 |
| E | 80 | — | — | 20 | — | 112.7 |
| F | — | — | 80 | 20 | — | 181 |

Thread forming efficiency of mixture of phosphosulfurized oil and methyl ester exceeds value for mineral oil as well as mineral oil plus individual components: i.e., phosphosulfurized oil as ester.

Data shown in Table 2 shows that an 80/20 combination of phosphosulfurized oil and organic acid methyl esters provide exceptionally high forming efficiencies (162% and 158% Blend B and C) when compared to a 200 SU at 100° F. paraffinic oil (Blend A). These values also exceed forming efficiencies obtained for the individual components; i.e., 80% phosphosulfurized adduct +20% 200 SUS oil has a forming efficiency of 121%, (Blend D), while a 20% blend of tall oil methyl ester gives a value of 112 (Blend E).

All of these lubricant compositions can be used neat, diluted with oil or emulsified to form aqueous dispersions. They are non-toxic and should therefore be ecologically acceptable at use concentration.

As indicated previously the hereinabove description is intended to illustrate the invention and not to limit any aspect thereof except as indicated in the appended claims.

We claim:

1. An antiwear/extreme pressure lubricant composition consisting essentially of a major amount of a hydrocarbon oil which has been phosphosulfurized in the presence of a metal oxide, the metal being selected from the group consisting of Group I or Group II of the Periodic Table, or cobalt, or molybdenum and a minor amount of an organic acid ester.

2. The lubricant composition of claim 1 adapted for use in metal forming operations.

3. The lubricant composition of claim 1 wherein the hydrocarbon oil is selected from mineral oils, synthetic oils and mixtures thereof.

4. The lubricant composition of claim 3 wherein the oil is a mineral oil selected from petroleum oil, petroleum oil fractions and refined petroleum oils.

5. The lubricant composition of claim 4 wherein said oil is a refined solvent paraffinic neutral oil.

6. The lubricant composition of claim 1 wherein the organic acid esters are prepared from mono- and polyhydric alcohols containing from 1 to about 6 carbon atoms reacted with organic acids containing from 4 to 30 carbon atoms.

7. The lubricant composition of claim 6 wherein said organic acid ester is tall oil methyl ester or $C_{10}$–$C_{18}$ methyl ester.

8. The lubricant composition of claims 1, 3, 5 or 7 wherein said metal oxide is lime or zinc oxide.

9. The lubricant composition of claims 1, 3, 5 or 7 comprising 60–90 wt. % of said phosphosulfurized/-metal oxide oil and 10–40 wt. % of said organic acid ester.

10. The lubricant composition of claim 9 comprising 80 wt. % phosphosulfurized oil using lime and 20 wt. % tall oil methyl ester.

11. The lubricant composition of claim 9 comprising 80 wt. % phosphosulfurized oil using lime and 20 wt. % $C_{10}$–$C_{18}$ methyl ester.

12. The lubricant composition of claim 9 comprising 80 wt. % phosphosulfurized oil using zinc oxide and 20 wt. % tall oil methyl ester.

13. The lubricant composition of claim 9 comprising 80 wt. % phosphosulfurized oil using zinc oxide and 20 wt. % $C_{10}$–$C_{18}$ methyl ester.

14. The lubricant composition of claim 1 diluted or blended with a mineral or synthetic oil of lubricating viscosity mixtures thereof or greases prepared therefrom.

15. The lubricant composition of claim 1 emulsified to an aqueous dispersion thereof.

* * * * *